US005807078A

United States Patent [19]

Chen

[11] Patent Number: 5,807,078

[45] Date of Patent: Sep. 15, 1998

[54] HAND AIR PUMPS

[76] Inventor: Chiang Pei Chen, No. 2, 296 Lane, Ming Sheng Rd., Wu Feng Hsiang, Taichung, Taiwan

[21] Appl. No.: 652,984

[22] Filed: May 24, 1996

[51] Int. Cl.[6] ..... F04B 3/00

[52] U.S. Cl. ..... 417/262

[58] Field of Search ..... 417/262, 248, 417/544, 260

[56] References Cited

U.S. PATENT DOCUMENTS 816,520 3/1906 Wray ..... 417/262 X
848,629 4/1907 Burkholder ..... 417/260
855,026 5/1907 Stapley ..... 417/260
1,306,382 6/1919 Koltz ..... 417/262 X

*Primary Examiner*—Ismael Izaguirre
*Attorney, Agent, or Firm*—Charles E. Baxley, Esq.

[57] ABSTRACT

A hand air pump includes a cylinder having a relatively small chamber and a relatively large chamber defined therein. A relatively small piston is slidably received in the relatively small chamber, and a relatively large piston is slidably received in the relatively large chamber. The two pistons are connected to an operative handle outside the cylinder. Air inside the relatively large chamber is accumulated in the relatively small chamber and is then outputted by the relatively small piston.

8 Claims, 16 Drawing Sheets

HAND AIR PUMPS

BACKGROUND OF THE INVENTION

1. Field of the Invention

The present invention relates to hand air pumps and, more particularly, to improved hand air pumps which allow users to operate them easily with a relatively small force and to rapidly achieve the inflation purpose.

2. Description of the Related Art

Hand air pumps are a commonly used article in daily life and a wide variety thereof have been heretofore provided. One type of the hand air pumps is intended to allow easy operation by both adults and children and thus includes a small piston mounted in a small cylinder. It is very smooth in the beginning of pumping for inflation purpose, yet after a certain amount of air has been pumped into an object to be inflated, e.g., a tyre, the inflation speed drops dramatically when the pressure in the object reaches a certain value. Accordingly, the user has to operate the pump with relatively large forces and the time for inflation increases to an unacceptable manner.

The present invention is intended to provide improved hand air pumps to mitigate and/or obviate the above drawbacks.

SUMMARY OF THE INVENTION

It is an object of the present invention to provide hand air pumps which allow users to operate them with a relatively small force to rapidly obtain high pressure.

In accordance with a first embodiment of the invention, a hand air pump comprises a cylinder having a relatively small chamber and a relatively large chamber defined therein which are separated by a separation wall therebetween and an operative handle outside the cylinder.

A relatively small piston is slidably received in the relatively small chamber and has a first side and a second side and a first O-ring mounted around a periphery thereof. The relatively small piston is connected to and thus actuatable by the operative handle via a first piston rod. A first opening is defined in an upper wall defining the relatively small chamber, thereby allowing the first piston rod to extend therethrough and intercommunicating the relatively small chamber with an environment. A first subchamber is defined between a bottom wall defining the relatively small chamber and the first side of the relatively small piston. A second subchamber is defined between the upper wall defining the relatively small chamber and the second side of the relatively small piston.

A relatively large piston is slidably received in the relatively large chamber and has a first side and a second side and a second O-ring mounted around a periphery thereof. The relatively large piston is connected to and thus actuatable by the operative handle via a second piston rod. A second opening is defined in an upper wall defining the relatively large chamber, thereby allowing the second piston rod to extend therethrough. A third O-ring is mounted in the second opening and around the second piston rod. A third subchamber is defined between a bottom wall defining the relatively large chamber and the first side of the relatively large piston. A fourth subchamber is defined between the upper wall defining the relatively large chamber and the second side of the relatively large piston.

A first air channel extends in the separation wall and has a first end in fluid communication with the fourth subchamber and a second end in fluid communication with the first subchamber, and a first check valve is mounted in the first air channel such that air is only flowable from the fourth subchamber to the first subchamber.

A second air channel extends in the separation wall and has a first end in fluid communication with the third subchamber and a second end in fluid communication with the first subchamber, and a second check valve is mounted in the second air channel such that air is only flowable from the third subchamber to the first subchamber.

A third air channel extends in the second piston rod and has a first end in fluid communication with the environment and a second end defined in the relatively large piston for fluid communication with the third subchamber. A third check valve is mounted in the third air channel such that air is only flowable from the environment to the third subchamber.

A fourth check valve is provided in the upper wall defining the relatively large chamber such that air is only flowable from the environment to the fourth subchamber. An air outlet is defined in a lower portion of a peripheral wall defining the relatively small chamber, and a fifth check valve is mounted in the air outlet such that air is only flowable from the first subchamber to the environment via the air outlet for inflation.

Preferably, the first end of the third air channel is defined in the operative handle, and a release rod extends in the third air channel and includes a first operative end mounted in the first end of the third air channel and a second end for opening the third check valve to release a pressure in the third subchamber under operation of the first operative end. Preferably, the first operative end of the release rod includes a control button.

In accordance with a second embodiment of the invention, a hand air pump comprises a cylinder having a relatively small chamber and a relatively large chamber defined therein which are separated by a separation wall therebetween and an operative handle outside the cylinder.

A relatively small piston is slidably received in the relatively small chamber and has a first side and a second side and a first O-ring mounted around a periphery thereof. The relatively small piston is connected to and thus actuatable by the operative handle via a first piston rod. A first opening is defined in an upper wall defining the relatively small chamber, thereby allowing the first piston rod to extend therethrough and intercommunicating the relatively small chamber with an environment. A first subchamber is defined between a bottom wall defining the relatively small chamber and the first side of the relatively small piston. A second subchamber is defined between the upper wall defining the relatively small chamber and the second side of the relatively small piston.

A relatively large piston is slidably received in the relatively large chamber and has a first side and a second side and an annular groove defined along a periphery thereof. The relatively large piston is connected to and thus actuatable by the operative handle via a second piston rod. A second opening is defined in an upper wall defining the relatively large chamber, thereby allowing the second piston rod to extend therethrough. A second O-ring is mounted in the second opening and around the second piston rod. A third subchamber is defined between a bottom wall defining the relatively large chamber and the first side of the relatively large piston. A fourth subchamber is defined between the upper wall defining the relatively large chamber and the second side of the relatively large piston. An annular flange is mounted in the annular groove and a third O-ring is mounted in the annular groove and between the annular flange and an inner peripheral wall defining the relatively large chamber such that air is only flowable from the third subchamber to the fourth subchamber via a gap generated between the annular flange and the third O-ring during a downward stroke of the relatively large piston.

A first air channel extends in the separation wall and has a first end in fluid communication with the fourth subchamber and a second end in fluid communication with the first subchamber, and a first check valve is mounted in the first air channel such that air is only flowable from the fourth subchamber to the first subchamber.

A second air channel extends in the second piston rod and has a first end in fluid communication with the environment and a second end defined in the relatively large piston for fluid communication with the third subchamber. A second check valve is mounted in the second air channel such that air is only flowable from the environment to the third subchamber.

A third check valve is provided in the upper wall defining the relatively large chamber such that air is only flowable from the environment to the fourth subchamber. An air outlet is defined in a lower portion of a peripheral wall defining the relatively small chamber, and a fourth check valve is mounted in the air outlet such that air is only flowable from the first subchamber to the environment via the air outlet for inflation.

Preferably, the first end of the second air channel is defined in the operative handle, and a release rod extends in the second air channel and includes a first operative end mounted in the first end of the second air channel and a second end for opening the second check valve to release a pressure in the third subchamber under operation of the first operative end.

In accordance with a third embodiment of the invention, a hand air pump comprises a cylinder having an upper relatively small chamber and a lower relatively large chamber defined therein which are separated by a separation wall therebetween and an operative handle outside the cylinder.

A relatively small piston is slidably received in the relatively small chamber and has a first side and a second side and a first O-ring mounted around a periphery thereof. A first opening is defined in an upper wall defining the relatively small chamber, thereby intercommunicating the relatively small chamber with an environment. A first subchamber is defined between the separation wall and the first side of the relatively small piston. A second subchamber is defined between the upper wall defining the relatively small chamber and the second side of the relatively small piston.

A relatively large piston is slidably received in the relatively large chamber and has a first side and a second side and a second O-ring mounted along a periphery thereof. A second opening is defined in the separation wall. The relatively large piston and the relatively small piston are connected to and thus actuatable by the operative handle via a common piston rod which extends through the second opening and the first opening. A third subchamber is defined between a bottom wall defining the relatively large chamber and the first side of the relatively large piston. A fourth subchamber is defined between the separation wall defining the relatively large chamber and the second side of the relatively large piston. An annular groove is defined in an annular wall defining the second opening. An annular flange is mounted in the annular groove. A third O-ring is mounted in the annular groove and between the common piston rod and the annular flange such that air is only flowable from the fourth subchamber to the first subchamber via a gap generated between the annular flange and the third O-ring during an upward stroke of the common piston.

A first air channel extends in the common piston rod and has a first outlet end in fluid communication with the environment and a second end defined in the relatively large piston for fluid communication with the third subchamber. A first check valve is mounted in the first air channel such that air is only flowable from the third subchamber to the first outlet end of the first air channel for inflation.

A second check valve is provided in an upper wall defining the relatively large chamber such that air is only flowable from the environment to the fourth subchamber. An air inlet is defined in a lower portion of a peripheral wall defining the relatively large chamber and includes a first end in fluid communication with the third subchamber and a second end in fluid communication with the environment. A third check valve is mounted in the air inlet such that air is only flowable from the environment to the third subchamber.

A third air channel is defined in the relatively small piston and has a first end in fluid communication with the first air channel and a second end in fluid communication with the first subchamber. A fourth check valve is mounted in the third air channel such that air is only flowable from the first subchamber to the first air channel.

Preferably, a pressure release button is mounted to the fourth check valve for releasing pressure inside the third subchamber.

In accordance with a fourth embodiment of the invention, a hand air pump comprises a cylinder having an upper relatively small chamber and a lower relatively large chamber defined therein which are separated by a separation wall therebetween and an operative handle outside the cylinder.

A relatively small piston is slidably received in the relatively small chamber and has a first side and a second side and a first O-ring mounted around a periphery thereof. A first opening is defined in an upper wall defining the relatively small chamber, thereby intercommunicating the relatively small chamber with an environment. A first subchamber is defined between the separation wall and the first side of the relatively small piston. A second subchamber is defined between the upper wall defining the relatively small chamber and the second side of the relatively small piston.

A relatively large piston is slidably received in the relatively large chamber and has a first side and a second side and an annular groove defined along a periphery thereof. A second opening is defined in the separation wall. A second O-ring is mounted in the second opening and around the common piston rod. The relatively large piston and the relatively small piston are connected to and thus actuatable by the operative handle via a common piston rod which extends through the second opening and the first opening. A third subchamber is defined between a bottom wall defining the relatively large chamber and the first side of the relatively large piston. A fourth subchamber is defined between the separation wall defining the relatively large chamber and the second side of the relatively large piston. An annular flange is mounted in the annular groove. A third O-ring is mounted in the annular groove and between the annular flange and an inner peripheral wall defining the relatively large chamber such that air is only flowable from the third subchamber to the fourth subchamber via a gap generated between the annular flange and the third O-ring during a downward stroke of the common piston.

A first air channel extends in the common piston rod and has a first inlet end in fluid communication with the environment and a second end defined in the relatively large piston for fluid communication with the third chamber. A first check valve is mounted in the first air channel such that air is only flowable from the first inlet end of the first air channel to the third subchamber.

A second check valve is provided in the separation wall such that air is only flowable from the to the fourth subchamber to the first subchamber. An air outlet is defined in a lower portion of a peripheral wall defining the relatively small chamber and includes a first end in fluid communication with the first subchamber and a second end in fluid communication with the environment, and a third check valve is mounted in the air outlet such that air is only flowable from the first subchamber to the environment via the air outlet for inflation.

Other objects, advantages, and novel features of the invention will become more apparent from the following detailed description when taken in conjunction with the accompanying drawings.

DESCRIPTION OF THE PREFERRED EMBODIMENTS

Figure 1:
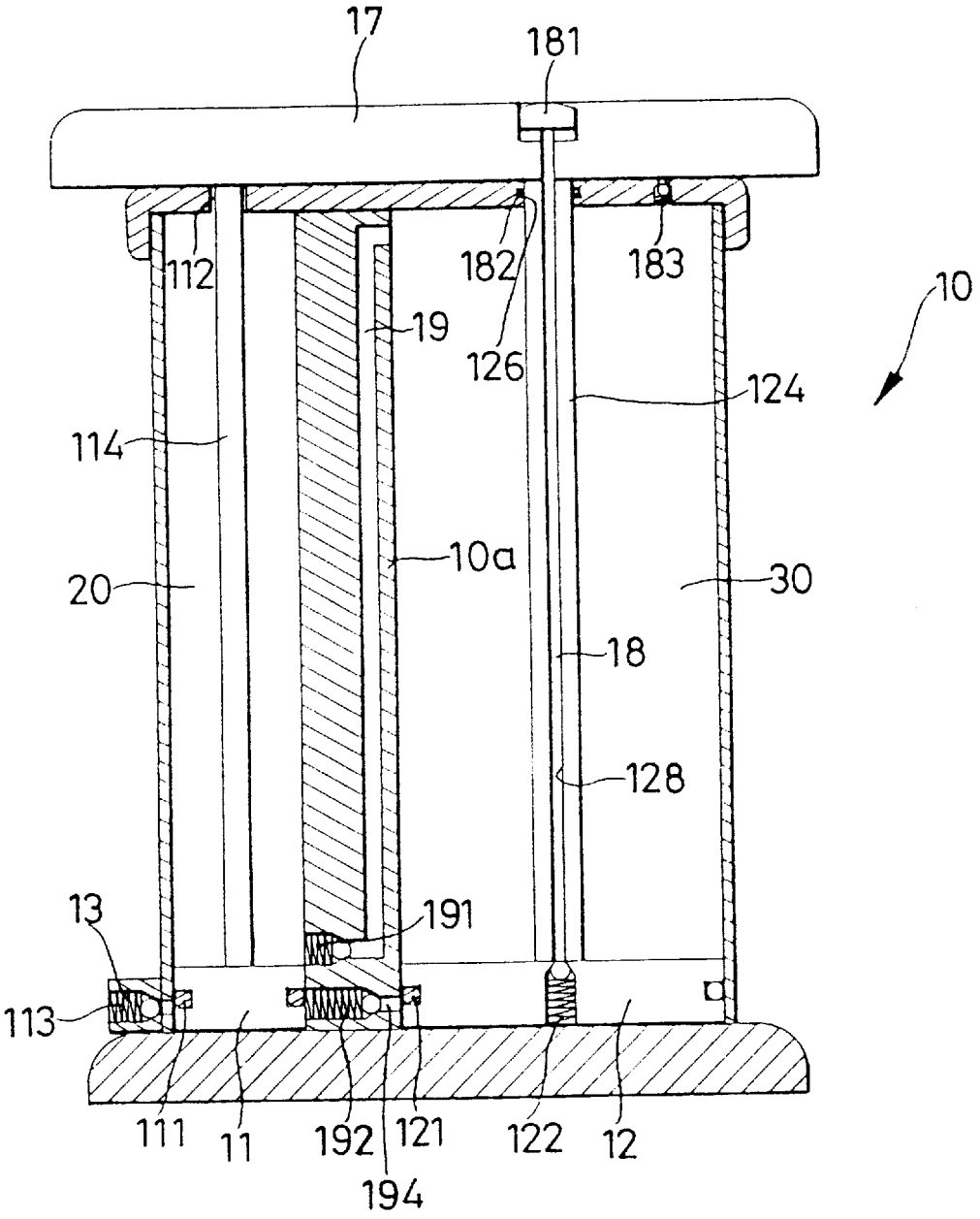
FIG. 1 is a schematic cross-sectional view of a first embodiment of a hand air pump in accordance with the present invention.

Referring to the drawings and initially to FIGS. 1 to 4, a first embodiment of a hand air pump in accordance with the present invention generally includes a cylinder 10 having a chamber defined therein and a separation wall 10*a* formed therein and separating the chamber into a relatively small chamber 20 and a relatively large chamber 30. A relatively small piston 11 is slidably mounted in the relatively small chamber 20 and has a first O-ring 111 mounted around a periphery thereof. A relatively large piston 12 is slidably mounted in the relatively large chamber 30 and has a first side and a second side and a second O-ring 121 mounted around a periphery thereof. The relatively small piston 11 and the relatively large piston 12 are connected to an operative handle 17 outside the cylinder 10 via a first piston rod 114 and a second piston rod 124, respectively.

A first opening 112 is defined in an upper wall defining the relatively small chamber 20, thereby allowing the first piston rod 114 to extend therethrough and intercommunicating the relatively small chamber 20 with an environment. A second opening 126 is defined in an upper wall defining the relatively large chamber 30, thereby allowing the second piston rod 124 to extend therethrough. An O-ring 182 is mounted in the second opening 126 and around the second piston rod 124. In this embodiment, the cylinder 10 includes a common upper wall and a common bottom wall defining the relatively large and small chambers.

Figure 2:
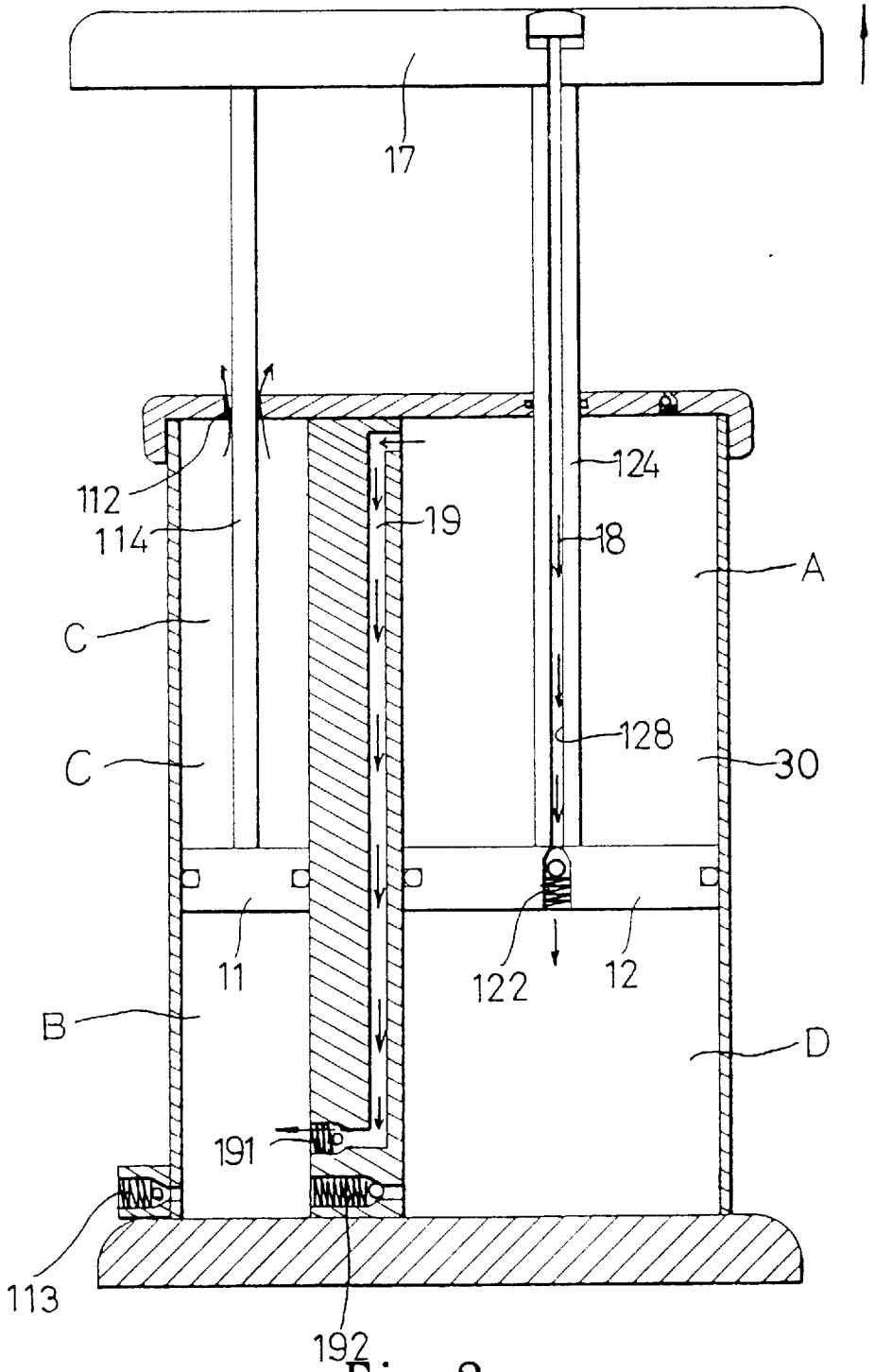
FIG. 2 is a schematic cross-sectional view illustrating an upward stroke of the hand air pump in FIG. 1.

Referring to FIG. 2, in the relatively small chamber 20, a subchamber B is defined between the bottom wall and a first side of the relatively small piston 11, while a subchamber C is defined between the upper wall and a second side of the relatively small piston 11. A first air channel 19 is defined in the separation wall 10*a* and includes a first end in fluid communication with a subchamber A defined between the second side of the relatively large piston 12 and the upper wall defining the relatively large chamber 30. A second end of the first air channel 19 is in fluid communication with the subchamber B, and a first check valve 191 is mounted in the second end of the first air channel 19 such that air is only flowable from the subchamber A to the subchamber B.

Furthermore, a second air channel 194 (see FIG. 1) is defined in a lower portion of the separation wall 10*a* and has a first end in fluid communication with a subchamber D defined between the first side of the relatively large piston 12 and the bottom wall defining the relatively large chamber 30. A second end of the second air channel 194 is in fluid communication with the subchamber B, and a second check valve 192 is mounted in the second air channel 194 such that air is only flowable from the subchamber D to the subchamber B.

A third air channel 128 extends in the second piston rod 124 and has a first end defined in the operative handle 17 for fluid communication with the environment and a second end defined in the relatively large piston 12 for fluid communication with the subchamber B. A third check valve 122 is mounted in the second end of the air channel 128 such that air is only flowable from the environment to the subchamber D.

A release rod 18 extends in the third air channel 128 and includes a first operative end in the first end of the third air channel 128 and a second end contacting with a ball of the first check valve 122. In this embodiment, the first operative end of the release rod 18 includes a button 181 of an enlarged diameter for easy pressing, which will be explained later.

A fourth check valve 183 is provided in the upper wall defining the relatively large chamber 30 such that air is only flowable from the environment to the subchamber A. An air outlet 13 is defined in a lower portion of a peripheral wall defining the relatively small chamber 20, and a fifth check valve 113 is mounted in the air outlet 13 such that air is only flowable from the subchamber B to the environment via the air outlet 13 for inflation.

Figure 3:
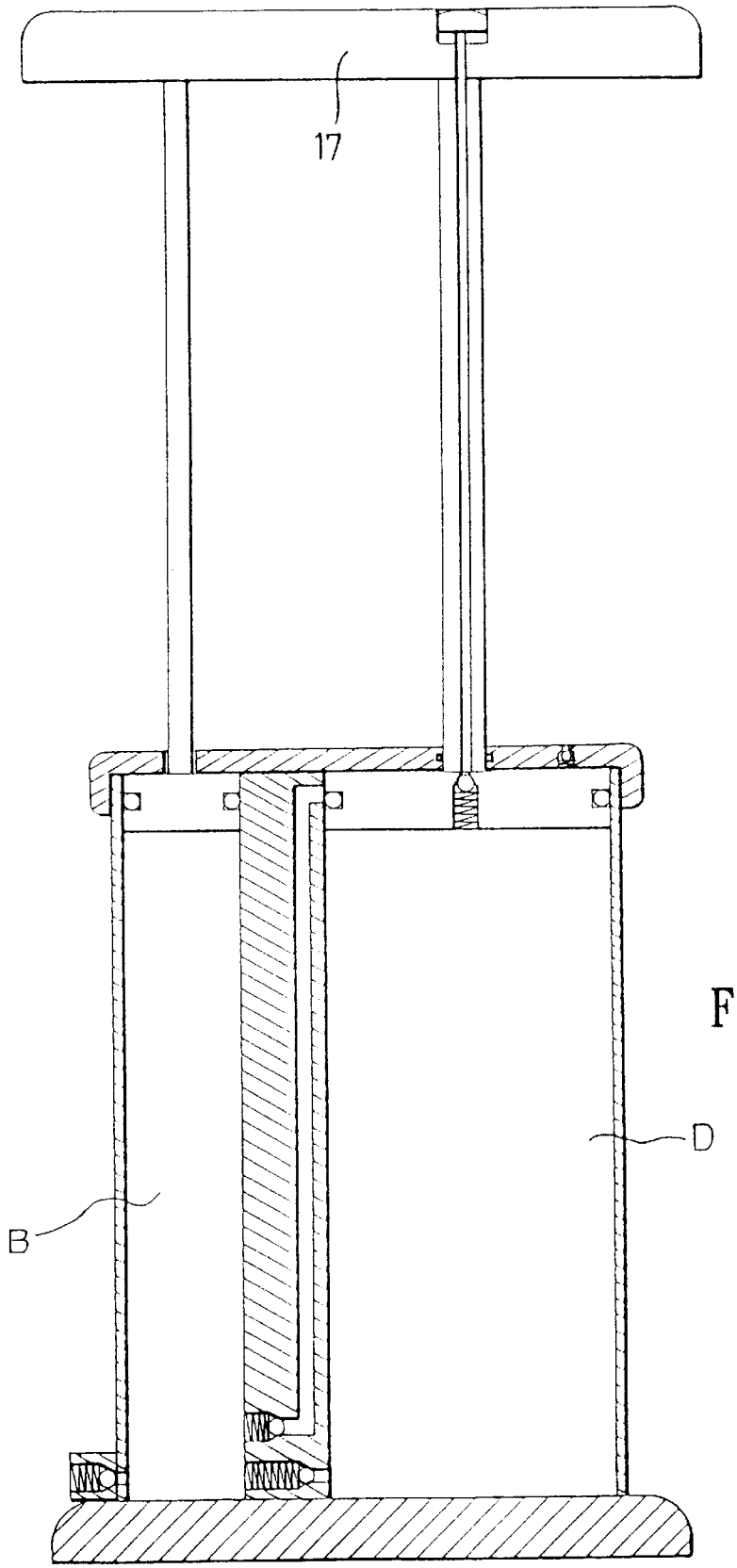
FIG. 3 is a schematic cross-sectional view similar to FIG. 1, in which an operative handle of the hand air pump is at its uppermost position.

In operation, referring to FIG. 2, in which the operative handle 17 is lifted upwardly such that the relatively small piston 11 and the relatively large piston 12 also move upwardly, thereby defining the subchambers A, B, C, and D. During the upward stroke of the pistons 11 and 12, the air inside the subchamber A flows into the subchamber B via the first air channel 19. The first check valve 191 is opened, yet the air pressure in the subchamber B is still not high enough to open the fifth check valve 113. The air inside the subchamber C flows outside the cylinder 10 via the first opening 112, while the environment air flows into the subchamber D via the third air channel 128, yet the air pressure inside the subchamber D is not high enough to open the second check valve 192. Referring to FIG. 3, when the operative handle 17 reaches its uppermost position, the subchamber A and the subchamber C do not exist, while the air originally inside the subchamber A completely enters the subchamber B.

Figure 4:
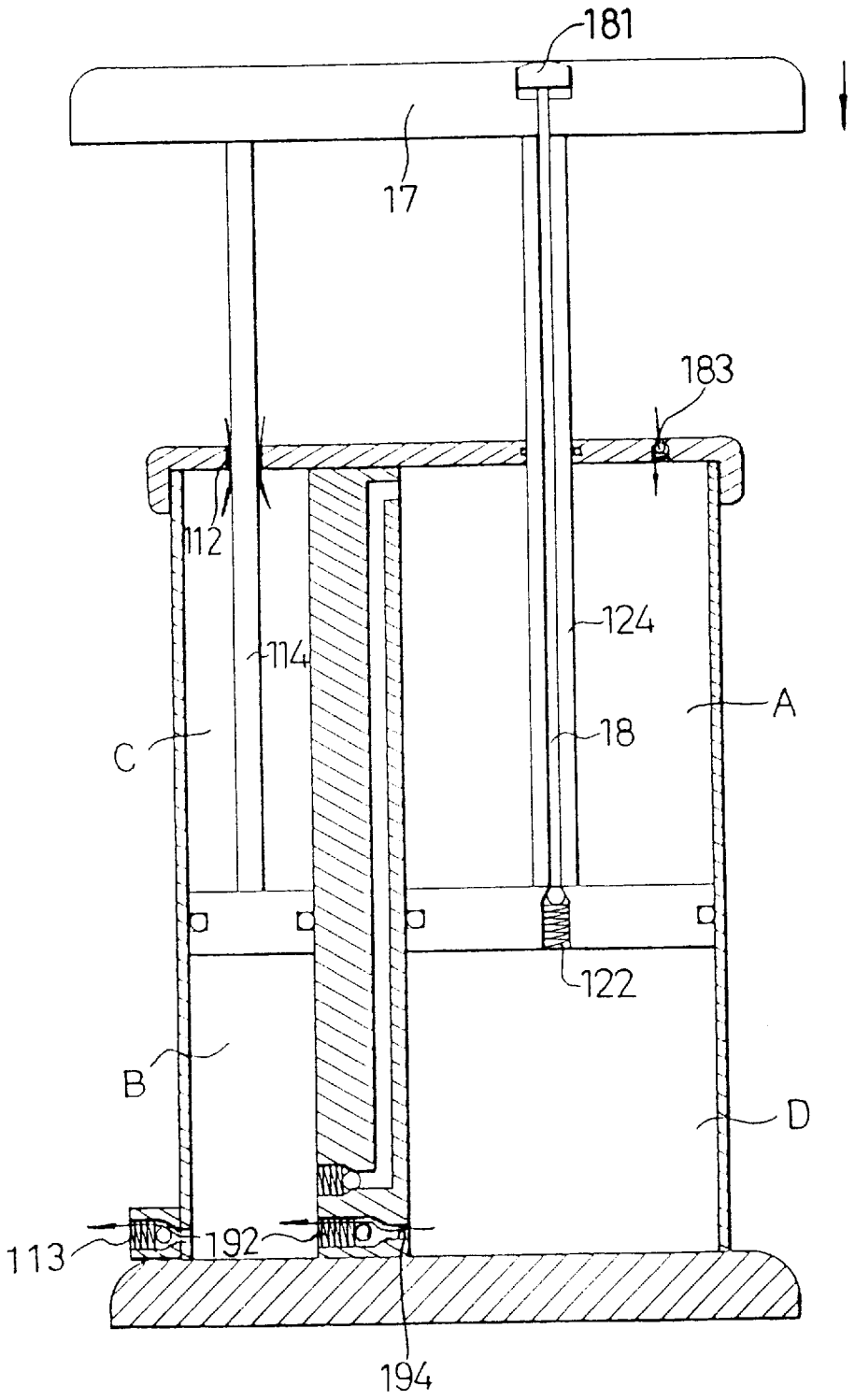
FIG. 4 is a schematic cross-sectional view illustrating a downward stroke of the hand air pump in FIG. 1.
Figure 5:
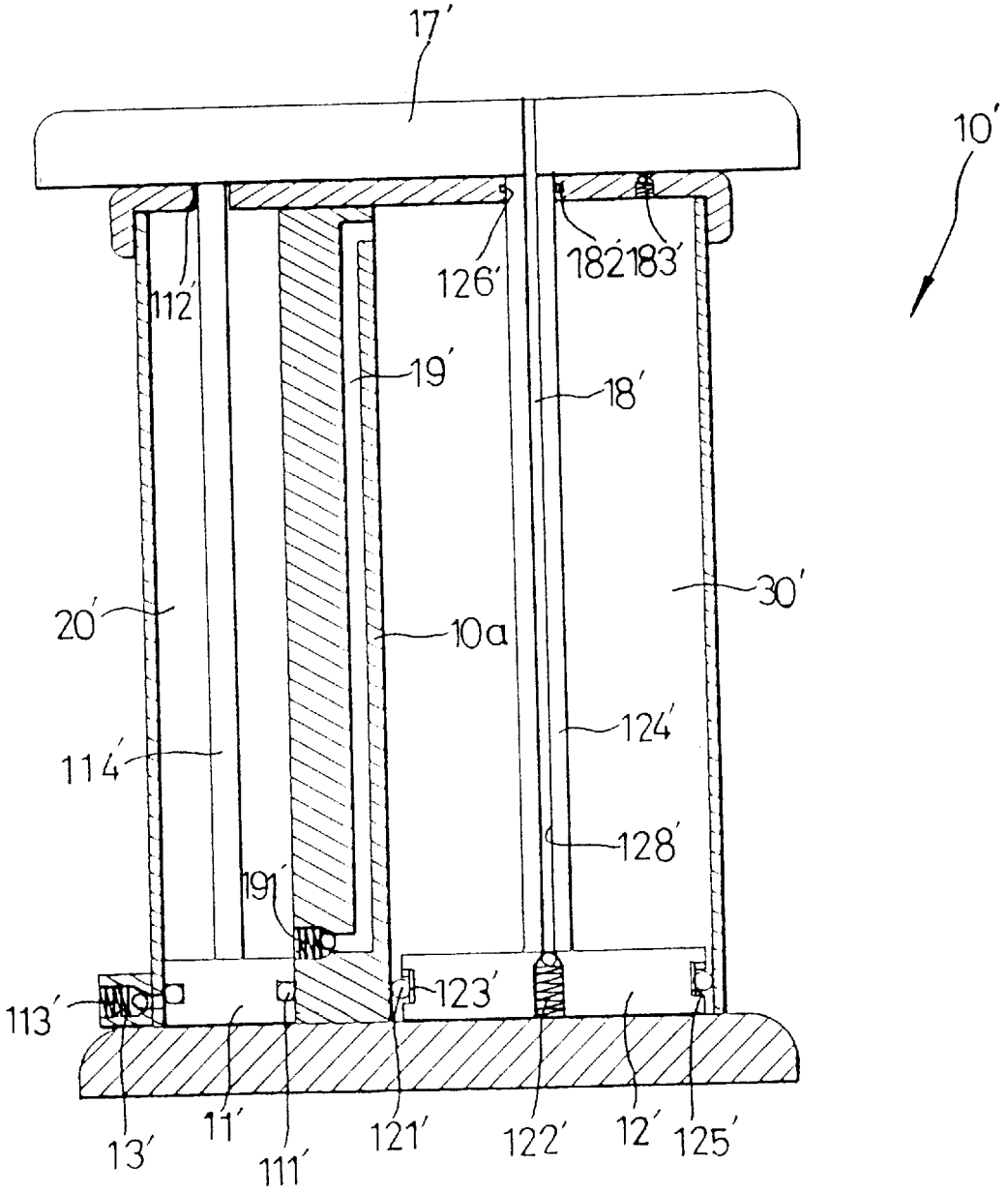
FIG. 5 is a schematic cross-sectional view of a second embodiment of a hand air pump in accordance with the present invention.

Referring to FIG. 4, when the operative handle 17 is moved downwardly, the pistons 11 and 12 also move downwardly, thereby again defining the subchambers A, B, C, and D. During the downward stroke of the pistons 11 and 12, the air inside the subchamber D enters the subchamber B via the second air channel 194 as the air pressure in the subchamber D is now high enough to open the second check valve 192, while the air inside the subchamber B flows outside the cylinder 10 via the outlet 13 for inflation purpose as the air pressure in the subchamber B is now high enough to open the fifth check valve 113. In the meantime, the environment air flows into the subchamber A via the fourth check valve 183 and into the subchamber C via the first opening 112. The fifth check valve 113 may be connected to a nozzle of a tyre or the like to be inflated, thereby achieving the required inflation function.

In brief, in the present hand air pump, the air pressure in the relatively large chamber 30 is accumulated in the subchamber B, and the high pressure air in the subchamber B (which includes the air from the subchamber A and subchamber D) is then pushed by the relatively small piston 11 which has a relatively small surface area. More specifically, the user may use a relatively small force to rapidly achieve the best inflation result (according to the equation P=F/A, wherein P is the pressure, F is force, and A is surface area).

If the operation does not require such a high pressure, the operator may push the release rod 18 downwardly at the button 181 to move the ball of the third check valve 122 downwardly, thereby allowing the air inside the subchamber D to flow outside the cylinder 10 via the third air channel 128 in order to release the pressure inside the subchamber D.

FIGS. 5 to 8 illustrates a second embodiment of a hand air pump in accordance with the present invention, in which like reference numerals designate like elements except that the reference numerals in FIGS. 4 to 8 are primed to provide a distinction. It is appreciated that the structure of the second embodiment is substantially the same as that of the first embodiment except for several different arrangements described hereinbelow. As can be seen by comparing FIG. 5 with FIG. 1, the air channel 194 and the check valve 192 in the first embodiment have been omitted. The button 181 in the first embodiment is also omitted. In addition, an annular groove 125' is defined along a periphery of the relatively large piston 12' and an annular flange 123' is mounted in the annular groove 125'. An O-ring 121' is mounted in the annular groove 125' and between the annular flange 123' and an inner peripheral wall defining the relatively large chamber 30' such that air is only flowable from the subchamber D to the subchamber A via a gap (not labeled, see FIG. 8) generated between the annular flange 123' and the O-ring 121' during a downward stroke of the relatively large piston 12'.

Figure 6:
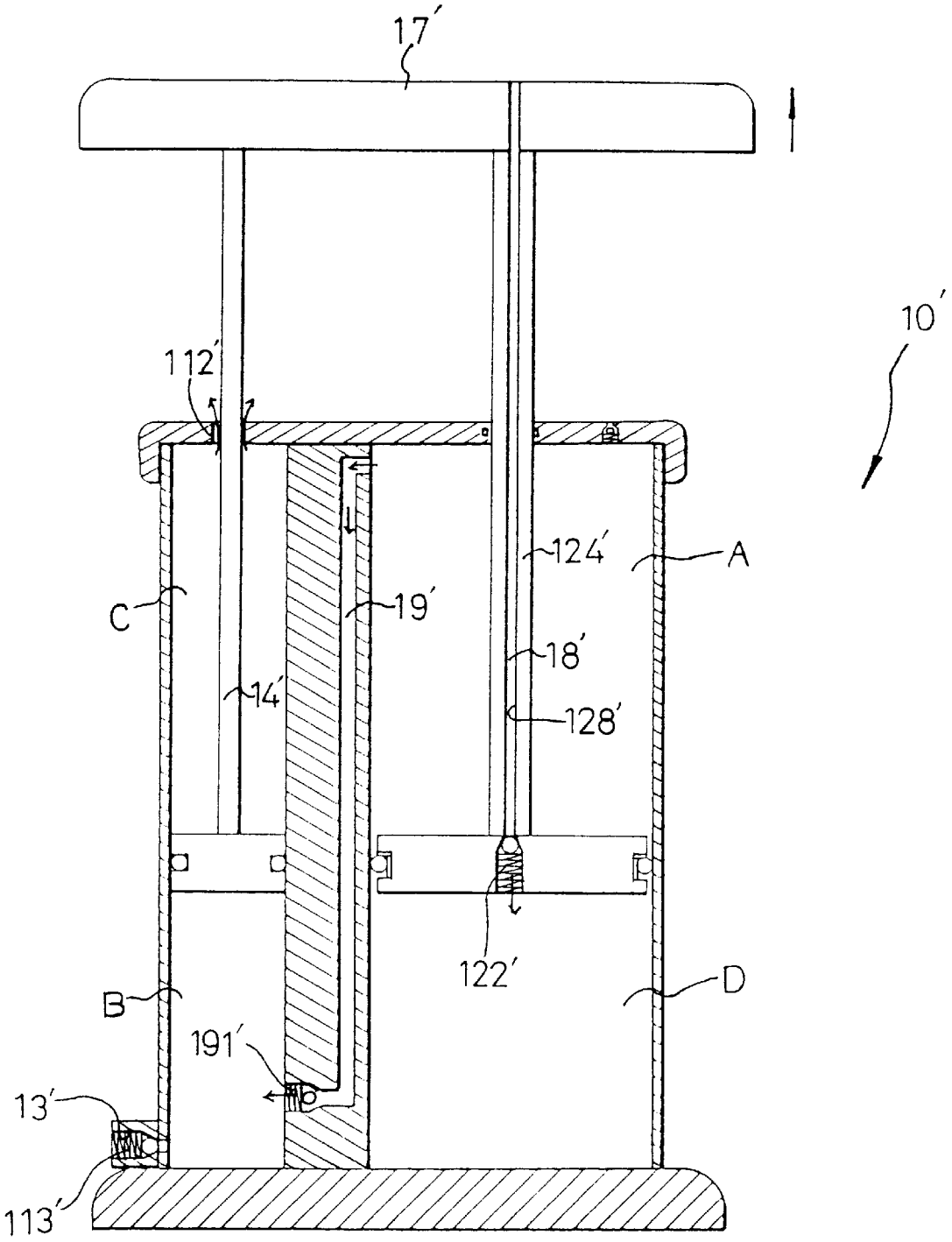
FIG. 6 is a schematic cross-sectional view illustrating an upward stroke of the hand air pump in FIG. 5.
Figure 7:
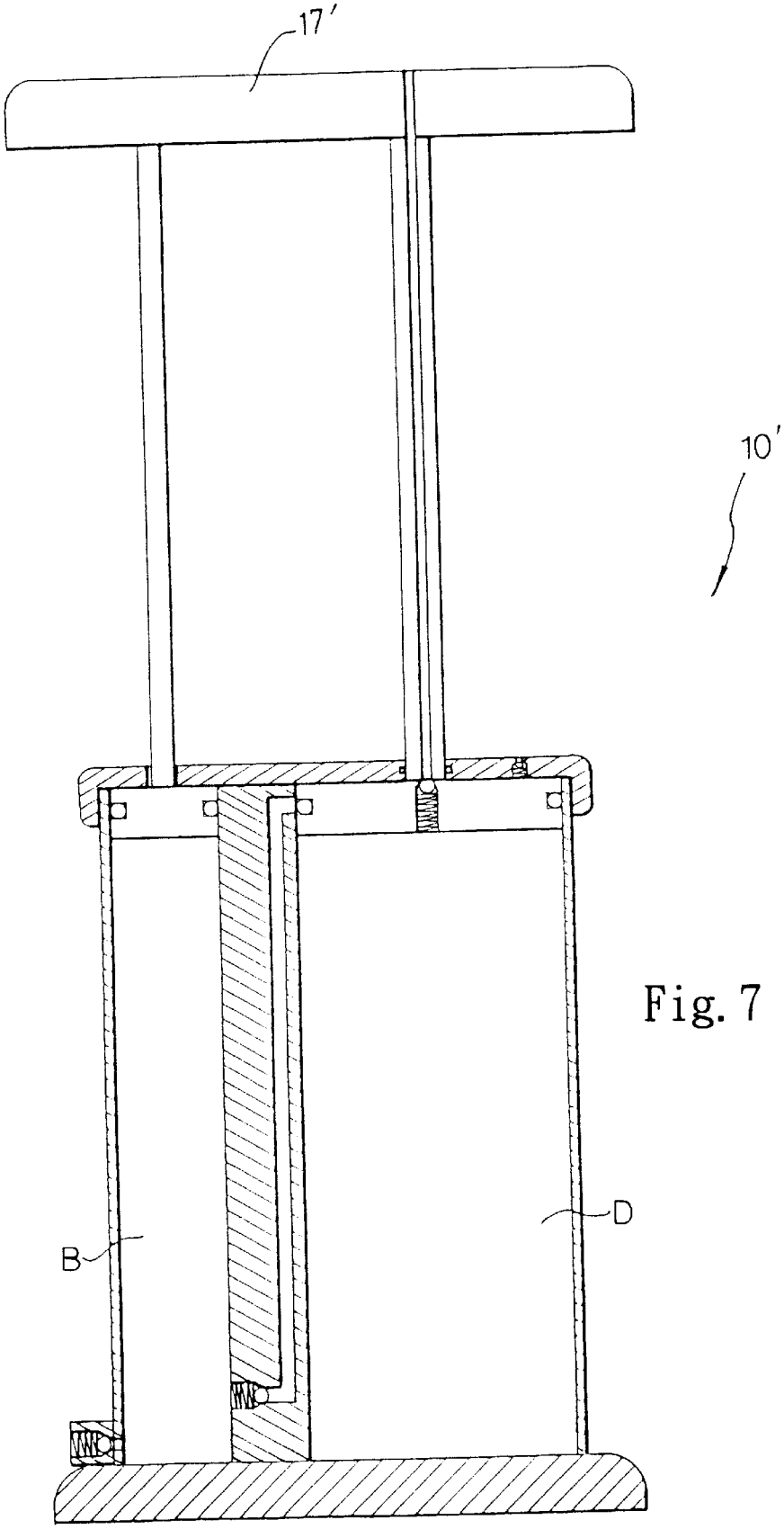
FIG. 7 is a schematic cross-sectional view similar to FIG. 5, in which an operative handle of the hand air pump is at its uppermost position.

In operation, referring to FIG. 6, in which the operative handle 17' is lifted upwardly such that the relatively small piston 11' and the relatively large piston 12' also move upwardly, thereby defining the subchambers A, B, C, and D. During the upward stroke of the pistons 11' and 12', the air inside the subchamber A flows into the subchamber B via the air channel 19'. The check valve 191' is opened, yet the air pressure in the subchamber B is not high enough to open the check valve 113'. The air inside the subchamber C flows outside the cylinder 10' via the first opening 112', while the environment air flows into the subchamber D via the air channel 128'. Referring to FIG. 7, when the operative handle 17' reaches its uppermost position, the subchamber A and the subchamber C do not exist, while the air originally inside the subchamber A completely enters the subchamber B.

Figure 8:
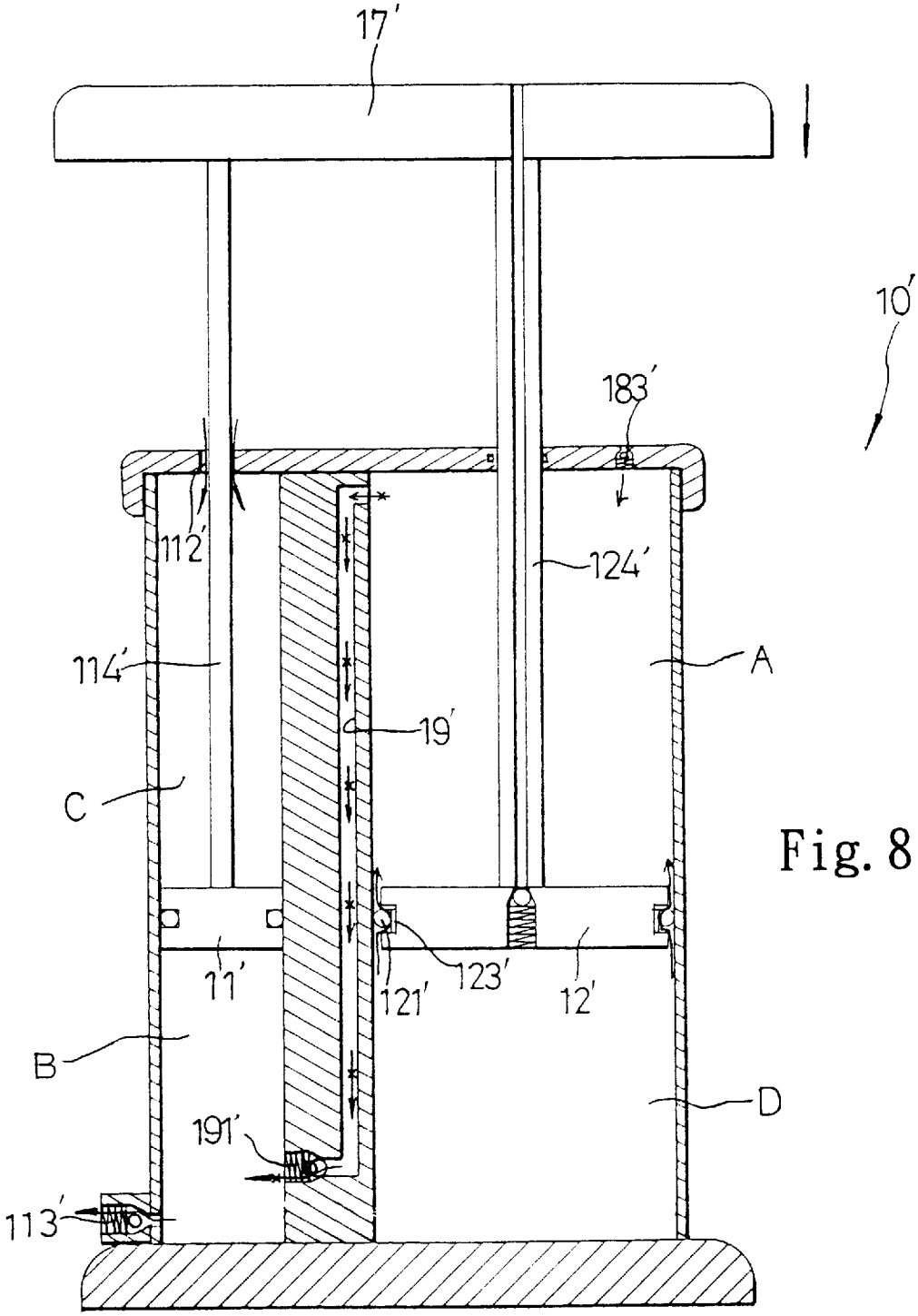
FIG. 8 is a schematic cross-sectional view illustrating a downward stroke of the hand air pump in FIG. 5.

Referring to FIG. 8, when the operative handle 17' is moved downwardly, the pistons 11' and 12' also move downwardly, thereby again defining the subchambers A, B, C, and D. During the downward stroke of the pistons 11' and 12', the air inside the subchamber D enters the subchamber A via the gap generated between the annular flange 123' and the O-ring 121' during the downward stroke. The air inside the subchamber A cannot enter the subchamber B via the air channel 19' and the check valve 191' is closed. The air pressure in the subchamber B is now high enough to open the check valve 113' and close the check valve 191', and the air inside the subchamber B thus flows outside the cylinder 10' via the air outlet 13'. In the meantime, the environment air flows into the subchamber C via the opening 112'. Again, the check valve 113' may be connected to a nozzle of a tyre or the like to be inflated, thereby achieving the required inflation purpose. It is appreciated that the valve 183' can be omitted for simplicity.

The second embodiment of the present hand air pump also allows the user to operate it with a relatively small force to rapidly achieve the required inflation purpose. This is because the air pressure in the relatively large chamber 30 is accumulated in the subchamber B, and the high pressure air in the subchamber B is then pushed by the relatively small piston 11' which has a relatively small surface area.

Figure 9:
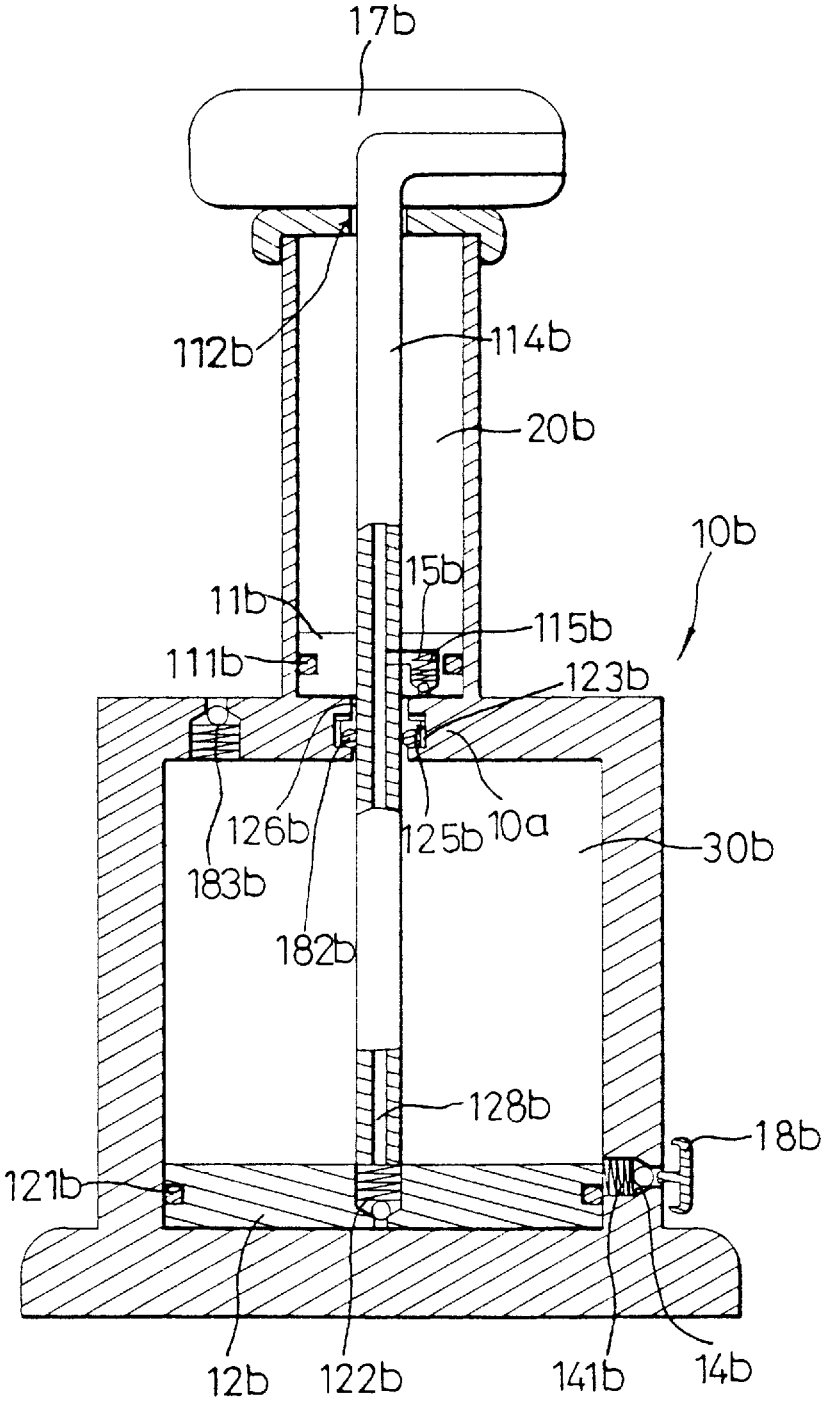
FIG. 9 is a schematic cross-sectional view of a third embodiment of a hand air pump in accordance with the present invention.

FIGS. 9 to 13 illustrate a third embodiment of a hand air pump in accordance with the present invention, in which like reference numerals designate like elements except that the reference numerals in FIGS. 9 to 13 are suffix with "b" to provide a distinction. In the third embodiment, as shown in FIG. 9, the hand air pump includes a cylinder **10*b* having a relatively small chamber 20*b* defined in an upper portion thereof and a relatively large chamber 30*b* defined in a lower portion thereof, the two chambers 20*b* and 30*b* are separated by a separation wall 10*a* therebetween. A relatively small piston 11*b* is slidably mounted in the relatively small chamber 20*b* and has a first O-ring 111*b* mounted around a periphery thereof. A relatively large piston 12*b* is slidably mounted in the relatively large chamber 30*b* and has a second O-ring 121*b* mounted around a periphery thereof. The relatively small piston 11*b* and the relatively large piston 12*b* are connected to an operative handle 17*b* outside the cylinder 10*b* via a common piston rod 124*b***.

Figure 10:
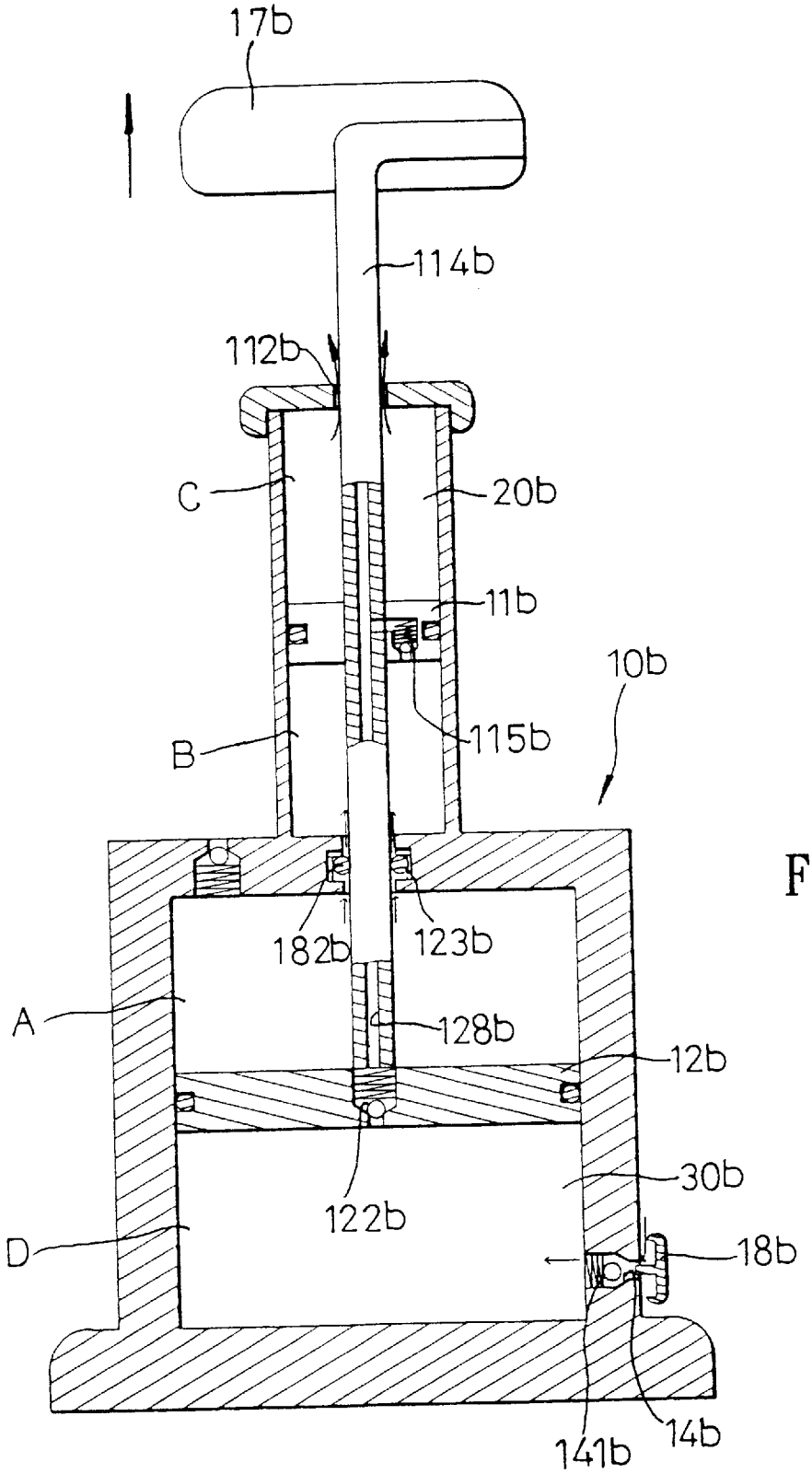
FIG. 10 is a schematic cross-sectional view illustrating an upward stroke of the hand air pump in FIG. 9.

A first opening **112*b* is defined in an upper wall defining the relatively small chamber 20*b*, thereby allowing the common piston rod 114***b* to extend therethrough and intercommunicating the relatively small chamber 20*b* with the environment. Referring to FIG. 10, a first subchamber B is defined between the separation wall 10*a* and a first side of the relatively small piston 11*b*. A second subchamber C is defined between the upper wall defining the relatively small chamber 20*b* and a second side of the relatively small piston 11*b*.

A second opening 126*b* (see FIG. 9) is defined in the separation wall 10*a* between the relatively large chamber 30*b* and the relatively small chamber 20*b*, thereby allowing the common piston rod 114*b* to extend therethrough. A third subchamber D (see FIG. 10) is defined between a bottom wall defining the relatively large chamber 30*b* and a first side of the relatively large piston 12*b*. A fourth subchamber "A" is defined between the separation wall 10*a* and a second side of the relatively large piston 12*b*.

Still referring to FIG. 9, an annular groove 125*b* is defined in an annular wall defining the second opening 126*b*, and an annular flange 123*b* is mounted in the annular groove 125*b*. A third O-ring 182*b* is mounted in the second opening 126*b* and between the common piston rod 114*b* and the annular flange 123*b* such that air is only flowable from the fourth subchamber A to the first subchamber B via a gap (not labeled, see FIG. 10) generated between the annular flange 123*b* and the third O-ring 182*b* during an upward stroke of the common piston 12*b*.

A first air channel 128*b* extends in the common piston rod 114*b* and has a first outlet end defined in the operative handle 17*b* for fluid communication with the environment and a second end defined in the relatively large piston 12*b* for fluid communication with the third subchamber D (see FIG. 10). A first check valve 122*b* is mounted in the second end of the first air channel 128*b* such that air is only flowable from the subchamber D to the environment via the first outlet end for inflation.

A second check valve 183*b* is provided in an upper wall defining the relatively large chamber 30*b* such that air is only flowable from the environment to the subchamber A.

An air inlet 14*b* is defined in a lower portion of a peripheral wall defining the relatively large chamber 30*b* and has a first end in fluid communication with the third subchamber D and a second and in fluid communication with the environment. A third check valve 141*b* is mounted in the air inlet 14*b* such that air is only flowable from the environment to the third subchamber D. A pressure release button 18*b* is mounted to the third check valve 141*b*, which will be explained later.

A third air channel 15*b* is defined in the relatively small piston 11*b* and includes a first end in fluid communication with the first subchamber B and a second end in fluid communication with the first air channel 128*b*. A fourth check valve 115*b* is mounted in the first end of the third air channel 15*b* such that air is only flowable from the first subchamber B to the first air channel 128*b*.

Figure 11:
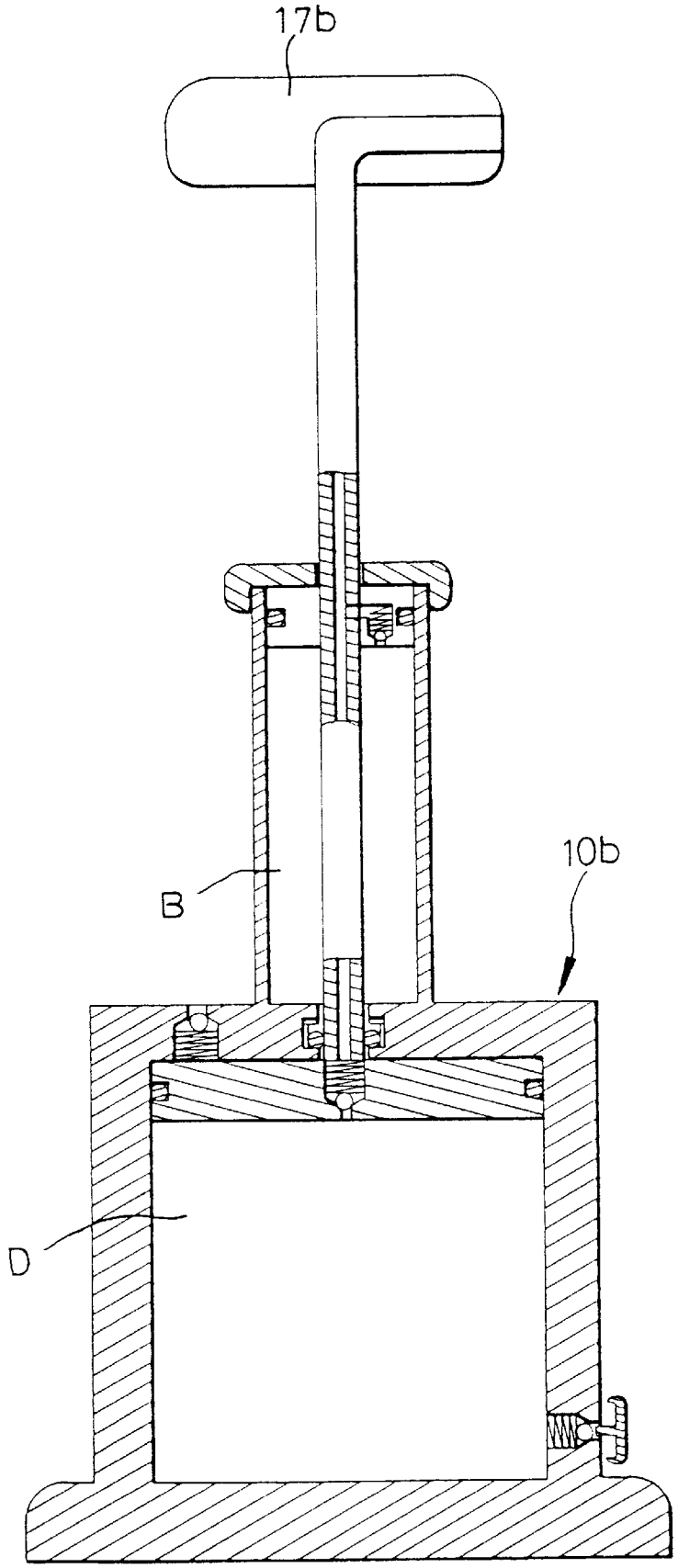
FIG. 11 is a schematic cross-sectional view similar to FIG. 9, in which an operative handle of the hand air pump is at its uppermost position.

In operation, referring to FIG. 10, in which the operative handle 17*b* is lifted upwardly such that the relatively small piston 11*b* and the relatively large piston 12*b* also move upwardly, thereby defining the subchambers A, B, C, and D. During the upward stroke of the pistons 11*b* and 12*b*, the air inside the subchamber A flows into the subchamber B via the gap generated between the annular flange 123*b* and the O-ring 182*b* during the upward stroke, the air inside the subchamber C flows outside the cylinder 10*b* via the first opening 112*b*, while the environment air flows into the subchamber D via the air inlet 14*b* and the third check valve 141*b*. The air pressures in the subchamber B and the subchamber D are not high enough to open the fourth check valve 115*b* and the first check valve 122', respectively. Referring to FIG. 11, when the operative handle 17*b* reaches its uppermost position, the subchamber A and the subchamber C do not exist, while the air originally inside the subchamber A completely enters the subchamber B.

Figure 12:
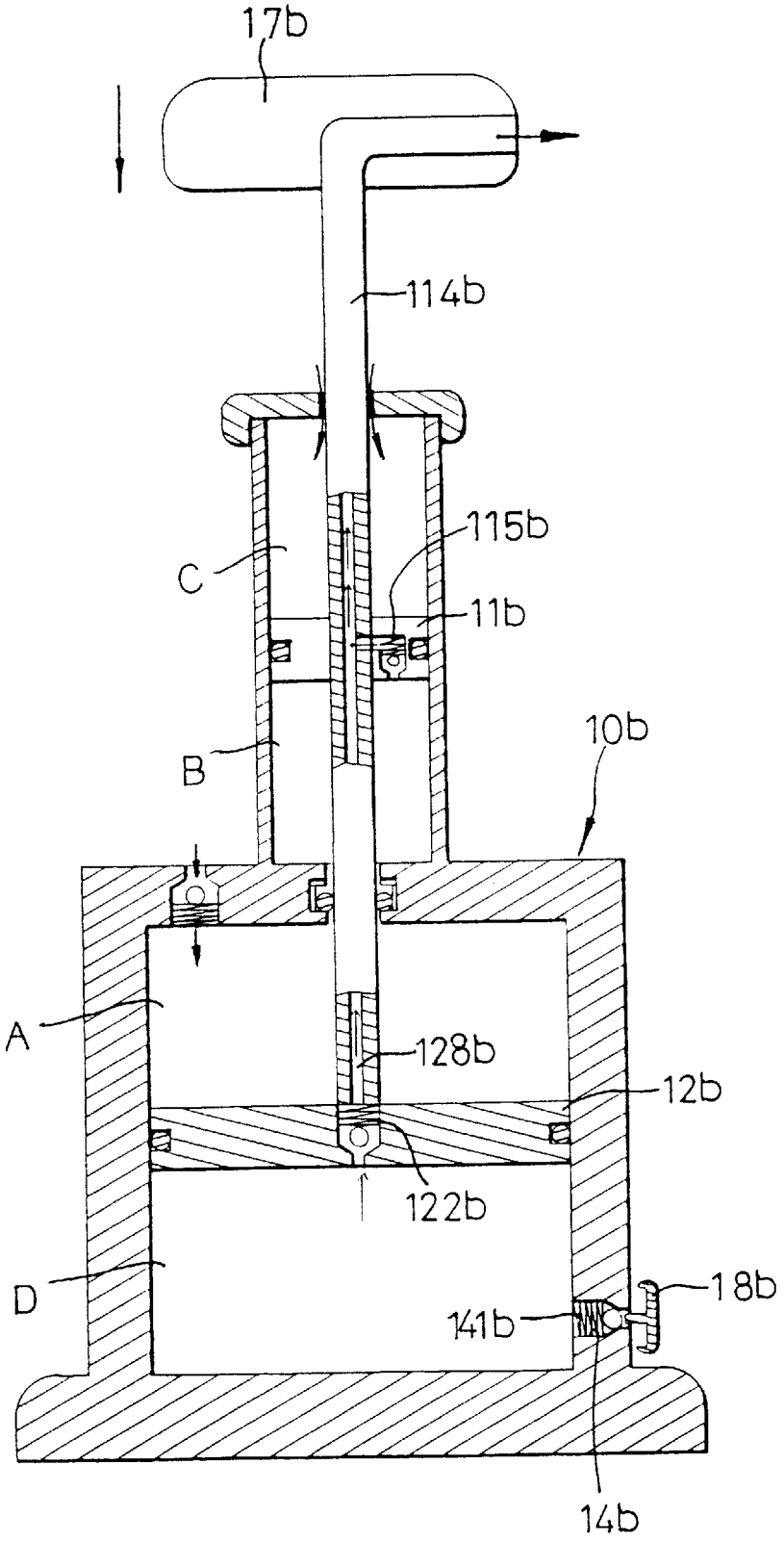
FIG. 12 is a schematic cross-sectional view illustrating a downward stroke of the hand air pump in FIG. 9.
Figure 13:
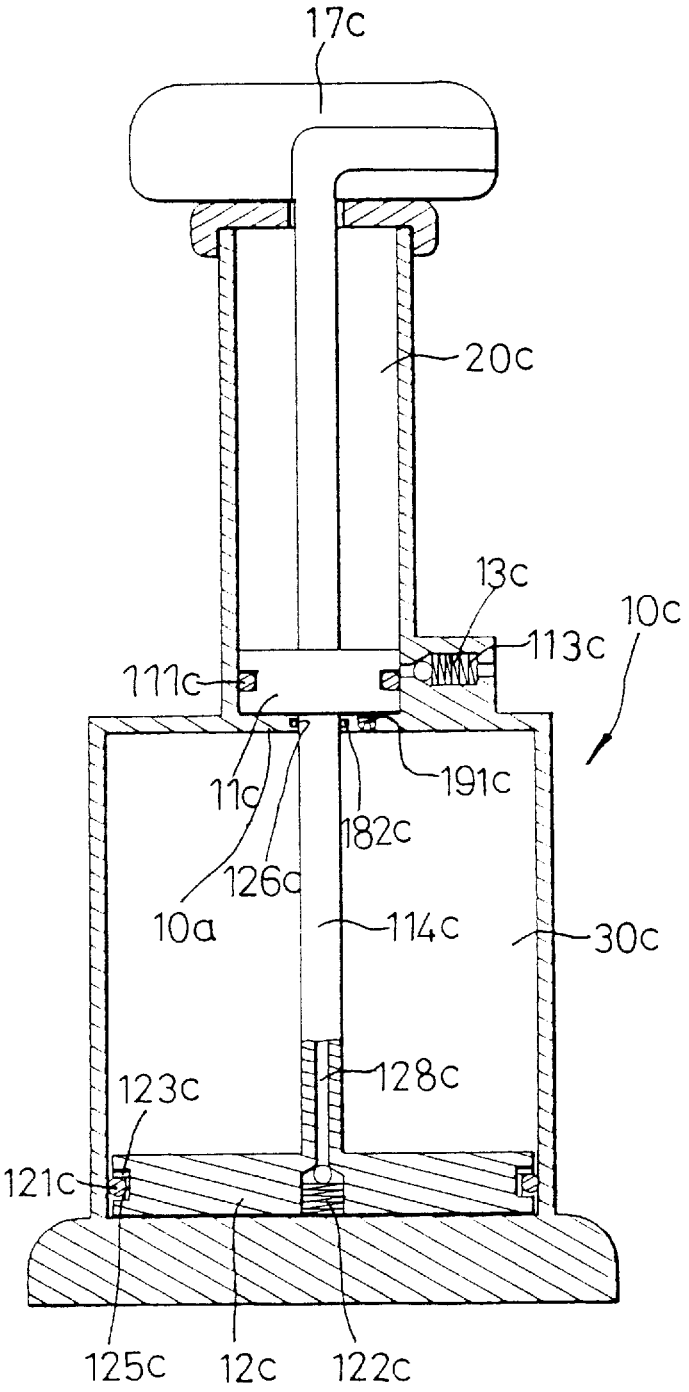
FIG. 13 is a schematic cross-sectional view of a fourth embodiment of a hand air pump in accordance with the present invention.

Referring to FIG. 12, when the operative handle 17*b* is moved downwardly, the pistons 11*b* and 12*b* also move downwardly, thereby again defining the subchambers A, B, C, and D. During the downward stroke of the pistons 11*b* and 12*b*, the air pressure in the subchamber D is now high enough to open the first check valve 122*b* so that the air inside the subchamber D enters the first air channel 128*b* and exits the cylinder 10*b* via the first outlet end in the operative handle 17*b* which, can be connected to a nozzle (not shown) of a tyre for inflation purpose. Meanwhile, the air pressure in the subchamber is now high enough to open the fourth check valve 115*b* so that the air inside the subchamber B flows enters the first air channel 128*b* via the third air channel 15*b* and then exits the cylinder 10*b* via the first outlet end of the first air channel 128*b*, thereby further increasing the inflation pressure and shortening the time required for inflation. In the meantime, the environment air flows into the subchamber C via the first opening 112*b*.

The third embodiment of the present hand air pump also allows the user to operate it with a relatively small force to rapidly achieve the required inflation purpose. This is because the air pressure in the relatively large chamber 30*b* is accumulated in the first subchamber B, and the high pressure air in the subchamber B is then pushed by the relatively small piston 11 which has a relatively small surface area. The air inside the third subchamber D further assists in the inflation, thereby shortening the time required for inflation.

If the operation does not require such a high pressure, the operator may push the release button 18*b* to move a ball of the third check valve 141*b*, thereby allowing the air inside the third subchamber D to flow outside the cylinder 10*b* via the second air channel 14*b* in order to release pressure inside the third subchamber D.

FIGS. 13 to 16 illustrate a fourth embodiment of a hand air pump in accordance with the present invention, in which like reference numerals designate like elements in FIGS. 9 to 12 except that the reference numerals in FIGS. 13 to 16 are suffixed with C to provide a distinction. It is appreciated that the fourth embodiment has a structure substantially the same as that of the third embodiment except for the following differences. The check valves 115*b* and 183*b* as well as the air channel 15*b* in the third embodiment are omitted. The pressure release button 18*b* and the air inlet channel 14*b* as well as the check valve 141*b* are also omitted. Furthermore, the flange 123*b* in the second opening 126*b* is also omitted. Instead, a check valve 191*b* is mounted in the separation wall 10*a* between the relatively small chamber 20*b* and the relatively large chamber 30*b* such that air is only flowable from the fourth subchamber A to the first subchamber B. In addition, an annular groove 125*c* is defined in a periphery of the relatively large piston 12*c*, and an annular flange 123*c* is mounted in the annular groove 125*c*. An O-ring 121*c* is mounted in the annular groove 125*c* and between the annular flange 123*c* and an inner peripheral wall defining the relatively large chamber 30*c* such that air is only flowable from the third subchamber D to the fourth subchamber A via a gap (not labeled, see FIG. 16) generated between the annular flange 123*c* and the O-ring 121*c* during a downward stroke of the relatively large piston 12*c*.

Furthermore, it is appreciated that the first air channel 128*c* now functions as an inlet tube, i.e., the check valve 122*c* mounted in the first air channel 128*c* is in a manner that air is only flowable from the environment to the third subchamber D. An air outlet 13*c* is defined in a lower portion of a peripheral wall defining the relatively small chamber 20*c* for intercommunicating the first subchamber B with the environment. A check valve 113*c* is mounted in the air outlet 13*c* such that air is only flowable from the first subchamber B to the environment via the air outlet 13*c* for inflation.

Figure 14:
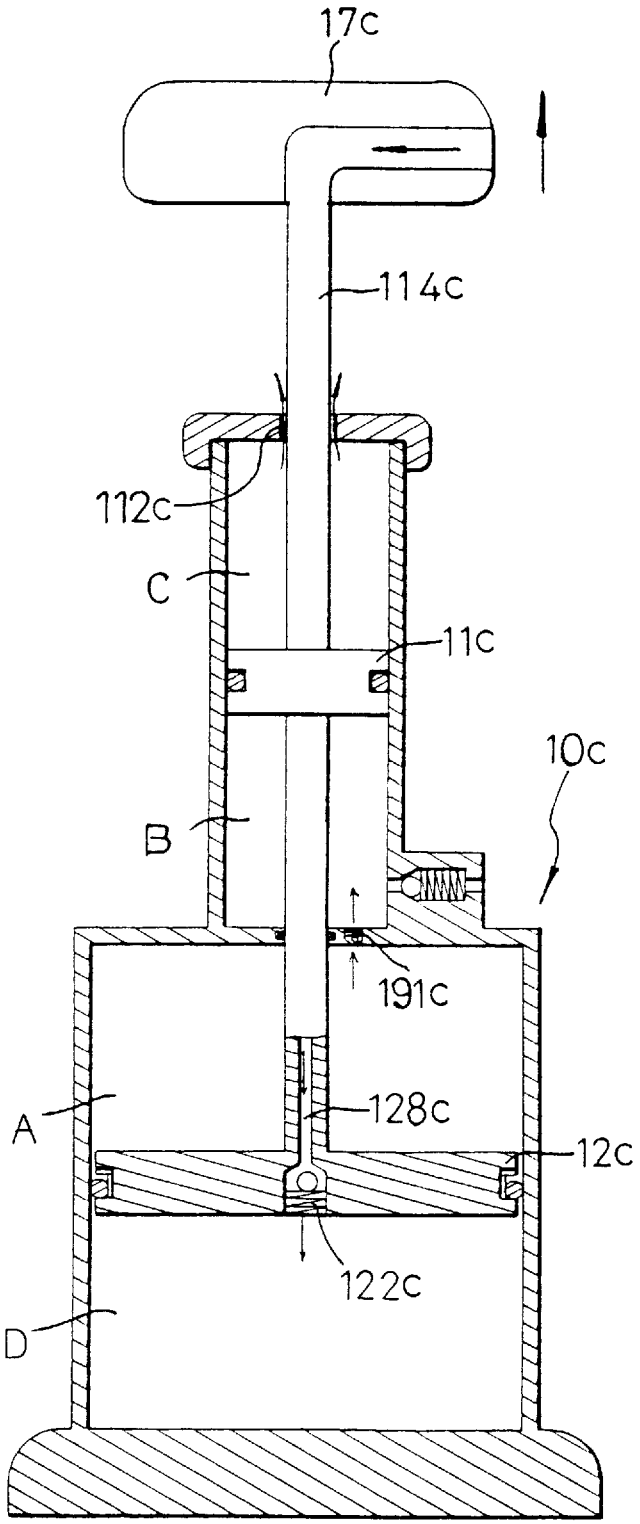
FIG. 14 is a schematic cross-sectional view illustrating an upward stroke of the hand air pump in FIG. 13.
Figure 15:
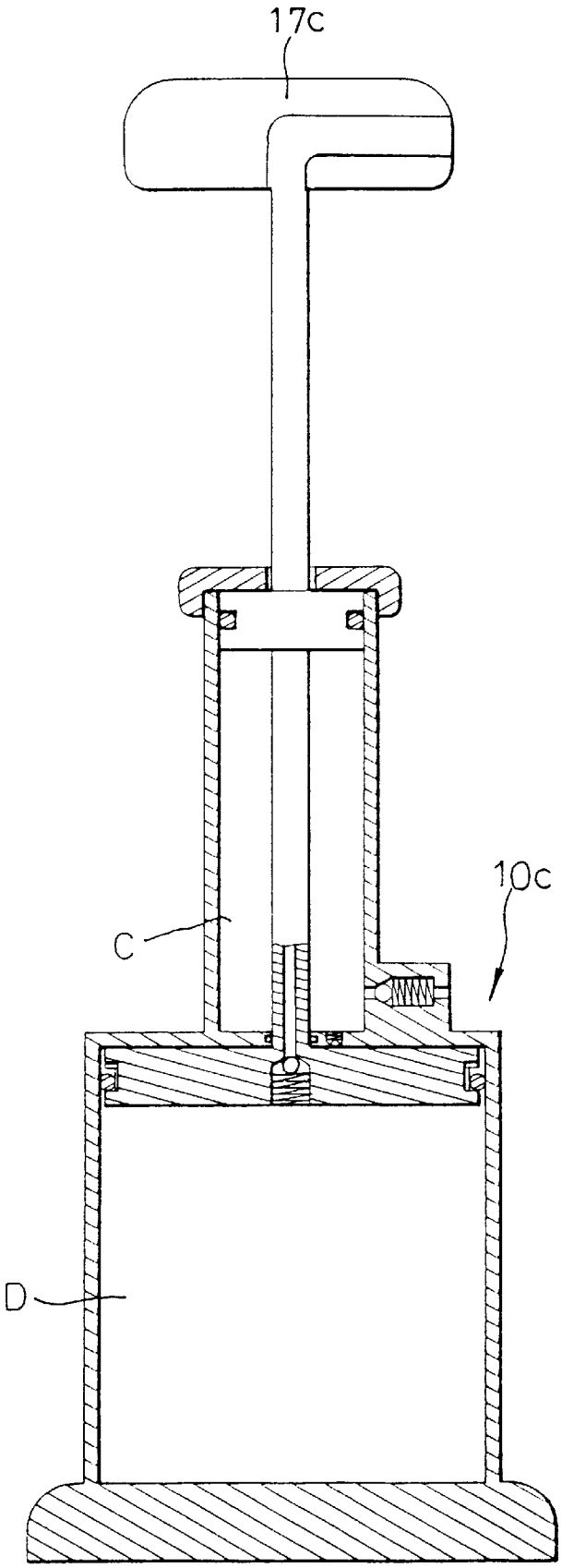
FIG. 15 is a schematic cross-sectional view similar to FIG. 13, in which an operative handle of the hand air pump is at its uppermost position.

In operation, referring to FIG. 14, in which the operative handle 17*c* is lifted upwardly such that the relatively small piston 11*c* and the relatively large piston 12*c* also move upwardly, thereby defining the subchambers A, B. C, and D. During the upward stroke of the pistons 11*c* and 12*c*, the air inside the subchamber A flows into the subchamber B via the check valve 191*c*. The air inside the subchamber C flows outside the cylinder 10*c* via the first opening 112*c*, yet the air pressure in the subchamber B is not high enough to open the check valve 113*c*. Meanwhile the environment air flows into the subchamber D via the first air channel 128*c*. Referring to FIG. 15, when the operative handle 17*c* reaches its uppermost position, the subchamber A and the subchamber C do not exist, while the air originally inside the subchamber A completely enters the subchamber B.

Figure 16:
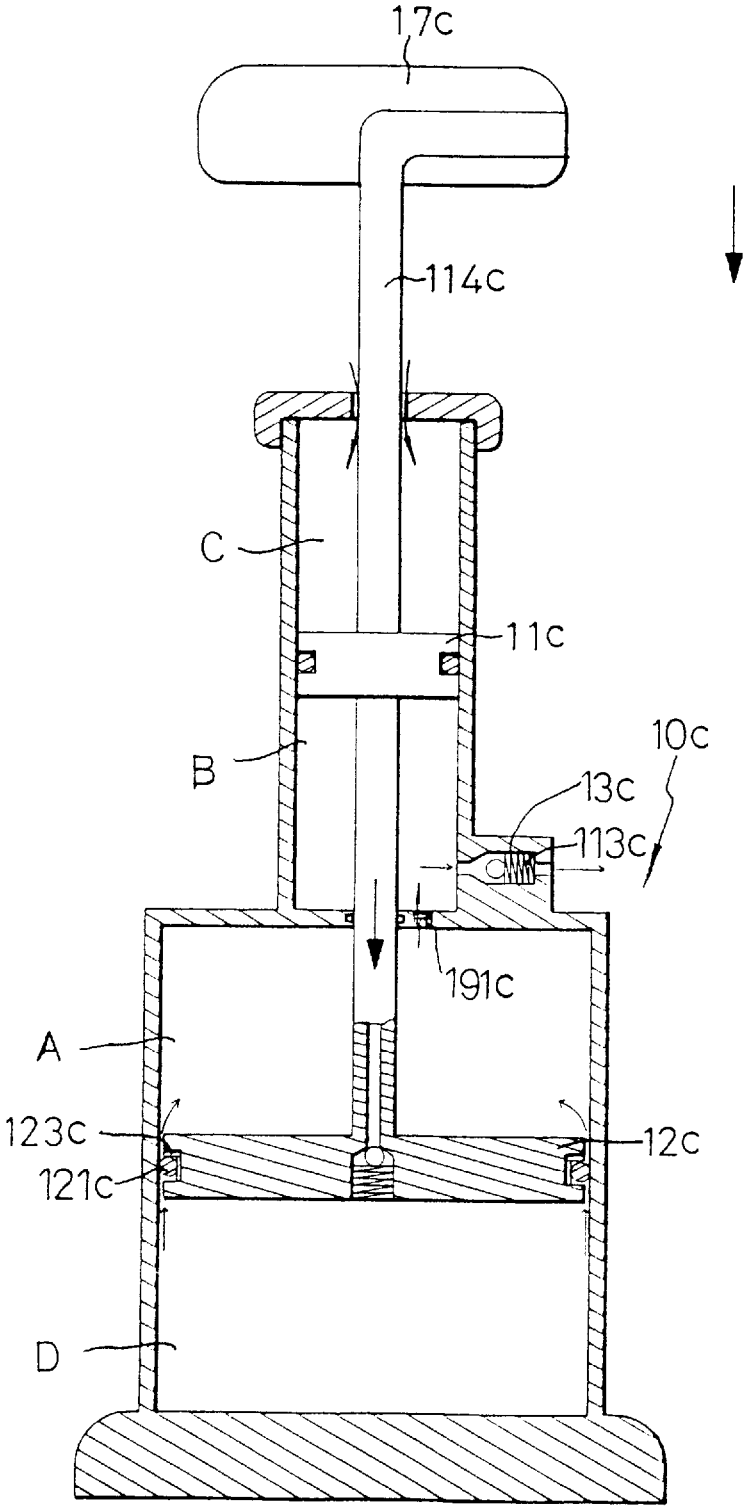
FIG. 16 is a schematic cross-sectional view illustrating a downward stroke of the hand air pump in FIG. 13.

Referring to FIG. 16, when the operative handle 17*c* is moved downwardly, the pistons 11*c* and 12*c* also move downwardly, thereby again defining the subchambers A, B, C, and D. During the downward stroke of the pistons 11*c* and 12*c*, the air inside the subchamber D enters the subchamber A via the gap generated between the annular flange 123*c* and the O-ring 121*c* during the downward stroke, while the air inside the subchamber A cannot enter the subchamber B via the check valve 191*c* as the check valve 191*c* is closed. Meanwhile, the air pressure in the subchamber B is now high enough to open the check valve 113*c* so that the air inside the subchamber B flows through the air outlet 13*c* which can be connected to a nozzle (not shown) of a tyre for inflation purpose. In the meantime, the environment air flows into the subchamber C via the first opening 112*c*.

The fourth embodiment of the present hand air pump also allows the user to operate it with a relatively small force to rapidly achieve the required inflation purpose. This is because the pressure in the relatively large chamber 30 is accumulated into the subchamber B, and the high pressure air in the subchamber B is then pushed by the relatively small piston 11"' which has a relatively small surface area.

Although the invention has been explained in relation to its preferred embodiment, it is to be understood that many other possible modifications and variations can be made without departing from the spirit and scope of the invention as hereinafter claimed.

What is claimed is:

1. A hand air pump comprising:

a cylinder (10) having a relatively small chamber (20) and a relatively large chamber (30) defined therein which are separated by a separation wall (10*a*) therebetween;

an operative handle (17) outside the cylinder;

a relatively small piston (11) slidably received in the relatively small chamber (20) and having a first side and a second side and a first O-ring (111) mounted around a periphery thereof, the relatively small piston being connected to and thus actuatable by the operative handle via a first piston rod (114), a first opening (112) being defined in an upper wall defining the relatively small chamber (20), thereby allowing the first piston rod (114) to extend therethrough and intercommunicating the relatively small chamber with an environment, a first subchamber (B) being defined between a bottom wall defining the relatively small chamber and the first side of the relatively small piston (11), a second subchamber (C) being defined between the upper wall defining the relatively small chamber and the second side of the relatively small piston (11);

a relatively large piston (12) slidably received in the relatively large chamber (30) and having a first side and a second side and a second O-ring (121) mounted around a periphery thereof, the relatively large piston being connected to and thus actuatable by the operative handle via a second piston rod (124), a second opening (126) being defined in an upper wall defining the relatively large chamber (30), thereby allowing the second piston rod (124) to extend therethrough, a third O-ring (182) being mounted in the second opening (126) and around the second piston rod (124), a third subchamber (D) being defined between a bottom wall defining the relatively large chamber and the first side of the relatively large piston (12), a fourth subchamber (A) being defined between the upper wall defining the relatively large chamber and the second side of the relatively large piston (12);

a first air channel (19) extending in the separation wall (10*a*) and having a first end in fluid communication with the fourth subchamber (A) and a second end in fluid communication with the first subchamber (B), and a first check valve (191) being mounted in the first air channel (19) such that air is only flowable from the fourth subchamber (A) to the first subchamber (B);

a second air channel (194) extending in the separation wall (10*a*) and having a first end in fluid communication with the third subchamber (D) and a second end in fluid communication with the first subchamber (B), and a second check valve (192) being mounted in the second air channel (194) such that air is only flowable from the third subchamber (D) to the first subchamber (B);

a third air channel (128) extending in the second piston rod (124) and having a first end in fluid communication with the environment and a second end defined in the relatively large piston (12) for fluid communication with the third subchamber (D), a third check valve (122) being mounted in the third air channel (128) such that air is only flowable from the environment to the third subchamber (D);

a fourth check valve (183) being provided in the upper wall defining the relatively large chamber (30) such that air is only flowable from the environment to the fourth subchamber (A); and an air outlet (13) being defined in a lower portion of a peripheral wall defining the relatively small chamber (20), and a fifth check valve (113) being mounted in the air outlet (13) such that air is only flowable from the first subchamber (B) to the environment via the air outlet (13) for inflation.

2. The hand air pump as claimed in claim 1, wherein the first end of the third air channel (128) is defined in the operative handle (17), and further comprising a release rod (18) extending in the third air channel (128) and including a first operative end mounted in the first end of the third air channel (128) and a second end for opening the third check valve (122) to release a pressure in the third subchamber (D) under operation of the first operative end.

3. The hand air pump as claimed in claim 2, wherein the first operative end of the release rod (18) includes a control button (181).

4. A hand air pump comprising:

a cylinder (10') having a relatively small chamber (20') and a relatively large chamber (30') defined therein which are separated by a separation wall (10*a*) therebetween;

an operative handle (17') outside the cylinder;

a relatively small piston (11') slideably received in the relatively small chamber (20') and having a first side and a second side and a first O-ring (111') mounted around a periphery thereof, the relatively small piston being connected to and thus actuatable by the operative handle via a first piston rod (114'), a first opening (112') being defined in an upper wall defining the relatively small chamber (20'), thereby allowing the first piston rod (114') to extend therethrough and intercommunicating the relatively small chamber with an environment, a first subchamber (B) being defined between a bottom wall defining the relatively small chamber and the first side of the relatively small piston (11'), a second subchamber (C) being defined between the upper wall defining the relatively small chamber and the second side of the relatively small piston (11');

a relatively large piston (12') slidably received in the relatively large chamber (30') and having a first side and a second side and an annular groove (125') defined along a periphery thereof, the relatively large piston being connected to and thus actuatable by the operative handle via a second piston rod (124'), a second opening (126') being defined in an upper wall defining the relatively large chamber (30'), thereby allowing the second piston rod (124') to extend therethrough, a second O-ring (182') being mounted in the second opening (126') and around the second piston rod (124'), a third subchamber (D) being defined between a bottom wall defining the relatively large chamber and the first side of the relatively large piston (12'), a fourth subchamber (A) being defined between the upper wall defining the relatively large chamber and the second side of the relatively large piston (12'), an annular flange (123') being mounted in the annular groove (125') and a third O-ring (121') being mounted in the annular groove (125') and between the annular flange (123') and an inner peripheral wall defining the relatively large chamber (30') such that air is only flowable from the third subchamber (D) to the fourth subchamber (A) via a gap generated between the annular glange (123') and the third O-ring (121') during a downward stroke of the relatively large piston (12');

a first air channel (19') extending in the separation wall (10*a*) and having a first end in fluid communication with the fourth subchamber (A) and a second end in fluid communication with the first subchamber (B), and a first check valve (191') being mounted in the first air channel (19') such that air is only flowable from the fourth subchamber (A) to the first subchamber (B);

a second air channel (128') extending in the second piston rod (124') and having a first end in fluid communication with the environment and a second end defined in the relatively large piston (12') for fluid communication with the third subchamber (D), a second check valve (122') being mounted in the second air channel (128') such that air is only flowable from the environment to the third subchamber (D); and an air outlet (13') being defined in a lower portion of a peripheral wall defining the relatively small chamber (20'), and a third check valve (113') being mounted in the air outlet (13') such that air is only flowable from the first subchamber (B) to the environment via the air outlet (13') for inflation.

5. The hand air pump as claimed in claim 4, wherein the first end of the second air channel (128') is defined in the operative handle (17'), and further comprising a release rod (18) extending in the second air channel (128') and including a first operative end mounted in the first end of the second air channel (128') and a second end for opening the second check valve (122') to release a pressure in the third subchamber (D) under operation of the first operative end.

6. A hand air pump comprising:

a cylinder (10*b*) having an upper relatively small chamber (20*b*) and a lower relatively large chamber (30*b*) defined therein which are separated by a separation wall (10*a*) therebetween;

an operative handle (17*b*) outside the cylinder;

a relatively small piston (11*b*) slidably received in the relatively small chamber (20*b*) and having a first side and a second side and a first O-ring (111*b*) mounted around a periphery thereof, a first opening ((112*b*) being defined in an upper wall defining the relatively small chamber (20*b*), thereby intercommunicating the relatively small chamber with an environment, a first subchamber (B) being defined between the separation wall (10*a*) and the first side of the relatively small piston (11*b*), a second subchamber (C) being defined between the upper wall defining the relatively small chamber and the second side of the relatively small piston (11*b*);

a relatively large piston (12*b*) slidably received in the relatively large chamber (30*b*) and having a first side and a second side and a second O-ring (121*b*) mounted along a periphery thereof, a second opening (126*b*) being defined in the separation wall (10*a*), the relatively large piston (12*b*) and the relatively small piston (11*b*) being connected to and thus actuatable by the operative handle (17*b*) via a common piston rod (114*b*) which extends through the second opening (126*b*) and the first opening (112*b*), a third subchamber (D) being defined between a bottom wall defining the relatively large chamber and the first side of the relatively large piston (12*b*), a fourth subchamber (A) being defined between the separation wall (10*a*) defining the relatively large chamber and the second side of the relatively large piston (12*b*), an annular groove (125*b*) being defined in an annular wall defining the second opening (126*b*), an annular groove (125*b*) being defined in an annular wall defining the second opening (126*b*), an annular flange (123*b*) being mounted in the annular groove (125*b*), a third O-ring (182*b*) being mounted in the annular groove (125*b*) and between the common piston rod (114*b*) and the annular flange (123*b*) such that air is only flowable from the fourth subchamber (A) to the first subchamber (B) via a gap generated between the annular flange (123*b*) and the third O-ring (182*b*) during an upward stroke of the common piston (12*b*);

a first air channel (128*b*) extending in the common piston rod (114*b*) and having a first outlet end in fluid communication with the environment and a second end defined in the relatively large piston (12*b*) for fluid communication with the third subchamber (D), a first check valve (122*b*) being mounted in the first air channel (128*b*) such that air is only flowable from the third subchamber (D) to the first outlet end of the first air channel (128*b*) for inflation;

second check valve (183*b*) being provided in an upper wall defining the relatively large chamber (30*b*) such that air is only flowable from the environment to the fourth subchamber (A);

an air inlet (14*b*) being defined in a lower portion of a peripheral wall defining the relatively large chamber (30*b*) and including a first end in fluid communication with the third subchamber (D) and a second end in fluid communication with the environment, and a third check valve (141*b*) being mounted in the air inlet (14*b*) such that air is only flowable from the environment to the third subchamber (D); and a third air channel (15*b*) being defined in the relatively small piston (11*b*) and having a first end in fluid communication with the first air channel (128*b*) and a second end in fluid communication with the first subchamber (B), and a fourth check valve (115*b*) being mounted in the third air channel (15*b*) such that air is only flowable from the first subchamber (B) to the first air channel (128*b*).

7. The hand air pump as claimed in claim 6, further comprising a pressure release button (18*b*) mounted to the fourth check valve (115*b*) for releasing pressure inside the third subchamber (D).

8. A hand air pump comprising:

cylinder (10*c*) having an upper relatively small chamber (20*c*) and a lower relatively large chamber (30*c*) defined therein which are separated by a separation wall (10*a*) therebetween;

an operative handle (17*c*) outside the cylinder;

a relatively small piston (11*c*) slidably received in the relatively small chamber (20*c*) and having a first side and a second side and a first O-ring (111*c*) mounted around a periphery thereof, a first opening (112*c*) being defined in an upper wall defining the relatively small chamber (20*c*), thereby intercommunicating the relatively small chamber with an environment, a first subchamber (B) being defined between the separation wall (10*a*) and the first side of the relatively small piston (11*c*), a second subchamber (C) being defined between the upper wall defining the relatively small chamber and the second side of the relatively small piston (11*c*);

a relatively large piston (12*c*) slidably received in the relatively large chamber (30*c*) and having a first side and a second side and an annular groove (125*c*) defined along a periphery thereof, a second opening (126*b*) being defined in the separation wall (10*a*), a second O-ring (182*c*) being mounted in the second opening (126*c*) and around the common piston rod (114*c*), the relatively large piston (12*c*) and the relatively small piston (11*c*) being connected to and thus actuatable by the operative handle (17*c*) via a common piston rod (114*c*) which extends through the second opening (126*c*) and the first opening (112*c*) a third subchamber (D) being defined between a bottom wall defining the relatively large chamber and the first side of the relatively large piston (12*c*), a fourth subchamber (A) being defined between the separation wall (10*a*) defining the relatively large chamber and the second side of the relatively large piston (12*c*), an annular flange (123*c*) being mounted in the annular groove (125*c*), a third O-ring (121*c*) being mounted in the annular groove (125*c*) and between the annular flange (123*c*) and an inner peripheral wall defining the relatively large chamber (30*c*) such that air is only flowable from the third subchamber (A) to the fourth subchamber (D) via a gap generated between the annular flange (123*c*) and the third O-ring (121*c*) during a downward stroke of the common piston (12*c*);

a first air channel (128*c*) extending in the common piston rod (114*c*) and having a first inlet end in fluid communication with the environment and a second end defined in the relatively large piston (12*c*) for fluid communication with the third subchamber (D), a first check valve (122*c*) being mounted in the first air channel (128*c*) such that air is only flowable from the first inlet end of the first air channel (128*c*) to the third subchamber (D);

a second check valve (191*c*) being provided in the separation wall (10*a*) such that air is only flowable from the fourth subchamber (A) to the first subchamber (B); and an air outlet (13*c*) being defined in a lower portion of a peripheral wall defining the relatively small chamber (20*c*) and including a first end in fluid communication with the first subchamber (B) and a second end in fluid communication with the environment, and a third check valve (113*c*) being mounted in the air outlet (13*c*) such that air is only flowable from the first subchamber (B) to the environment via the air outlet (13*c*) for inflation.

* * * * *